US010850808B2

(12) United States Patent
Robinson

(10) Patent No.: US 10,850,808 B2
(45) Date of Patent: Dec. 1, 2020

(54) ANCHORING DEVICE

(71) Applicant: Latch-N-Catch, Inc., Tyler, TX (US)

(72) Inventor: Gregory Robinson, Tyler, TX (US)

(73) Assignee: Latch-N-Catch, Inc., Tyler, TX (US)

( * ) Notice: Subject to any disclaimer, the term of this patent is extended or adjusted under 35 U.S.C. 154(b) by 0 days.

(21) Appl. No.: 16/434,327

(22) Filed: Jun. 7, 2019

(65) Prior Publication Data

US 2020/0031431 A1 Jan. 30, 2020

Related U.S. Application Data

(60) Provisional application No. 62/711,769, filed on Jul. 30, 2018.

(51) Int. Cl.

| | |
|---|---|
| ***B63B 21/08*** | (2006.01) |
| ***B63B 21/22*** | (2006.01) |
| ***B63B 21/24*** | (2006.01) |
| *B63B 21/00* | (2006.01) |

(52) U.S. Cl.

CPC ..... *B63B 21/08* (2013.01); *B63B 21/22* (2013.01); *B63B 21/24* (2013.01); *B63B 2021/005* (2013.01)

(58) Field of Classification Search

CPC ..... B63B 21/00; B63B 21/08; B63B 21/22; B63B 21/24; B63B 21/54; B63C 9/00

USPC ..... 114/221 R, 230.1, 230.14, 230.15, 114/230.17, 230.19, 230.18, 230.3

See application file for complete search history.

(56) References Cited

U.S. PATENT DOCUMENTS

| | | | | | |
|---|---|---|---|---|---|
| 2,956,531 | A * | 10/1960 | Banker | B63B 21/54 | 114/230.18 |
| 3,403,431 | A * | 10/1968 | Butler | B63B 21/54 | 114/230.3 |
| 4,741,283 | A * | 5/1988 | Conner | B63B 21/00 | 114/221 R |
| 4,834,437 | A * | 5/1989 | Howard, Sr. | B63B 21/00 | 114/221 R |
| 5,154,131 | A * | 10/1992 | Hall | B63B 21/54 | 114/230.3 |

* cited by examiner

*Primary Examiner* — Lars A Olson
(74) *Attorney, Agent, or Firm* — Kirby Drake

(57) ABSTRACT

An anchoring device may be arranged above or below a body of water and may secure or anchor watercraft to at least one vertical object and/or horizontally-positioned object. The anchoring device may provide a clamping mechanism that may secure the anchoring device to the at least one vertical object and/or horizontally-positioned object. The anchoring device may be integrated or fixed to watercraft, such as at a seat pedestal. The anchoring device also may be used without being integrated or fixed to watercraft.

17 Claims, 3 Drawing Sheets

ANCHORING DEVICE

CROSS-REFERENCE TO RELATED APPLICATION

This application claims the benefit of U.S. Provisional Application No. 62/711,769, entitled "ANCHORING DEVICE," filed Jul. 30, 2018, which is incorporated herein by reference in its entirety.

TECHNICAL FIELD

The disclosure relates generally to an anchoring device. In particular, the disclosure relates to an anchoring device for watercraft.

BACKGROUND

Anchors are generally provided to prevent watercraft from drifting away from a desired location or dock. Conventional anchors can include hooks that can be embedded in a seabed or the floor of a body of water. Users of these anchors can have uncertainty as to what lies beneath watercraft and/or how far anchors may need to travel to reach a seabed or floor. Securing watercraft to objects, such as trees or pillars, is typically performed utilizing rope. However, watercraft tend to sway and can fail to be adequately secured to the attached object when rope or other flexible materials are utilized for anchoring.

SUMMARY

Embodiments of the present disclosure generally may provide an anchoring device that may include a clamping mechanism. In some embodiments of the present disclosure, the anchoring device also may include a pedestal. The pedestal may be formed by two elongated members that may be connected by a pin or other similar fastening mechanism. The clamping mechanism may be formed by two ring members and may be connected to the two elongated members. While the clamping mechanism is described as formed by two ring members, there may be embodiments of the present disclosure where the members may be a shape other than a ring shape. The two ring members each may include a female connector arranged to connect with a male connector provided by each of the two elongated members. The pin or other similar fastening mechanism may provide a round head at each end and may be separable from the two elongated members. While the heads are described as round, there may be embodiments of the present disclosure where the heads are another shape. The two ring members may be arranged to anchor to at least one vertical object and/or horizontally-positioned object. The pedestal may be attached to the vertical object with the clamping mechanism and may be fixed to a watercraft. The watercraft may be a boat.

Further embodiments of the present disclosure may provide an anchoring device including a pedestal formed by two elongated members connected by a pin; and a clamping mechanism formed by two ring members, the clamping mechanism connected to the two elongated members. The two ring members may each include a female connector arranged to connect with a male connector provided by each of the two elongated members. The pin may provide a round head at each end of the pin. The pin may be separable from the two elongated members. The two ring members may be arranged to anchor to at least one vertical object. The pedestal may be attached to the at least one vertical object with the clamping mechanism. The pedestal may be fixed to a watercraft, which may be a boat, a yacht, a kayak, or a jet ski. The two ring members may be arranged to anchor to at least one horizontally-positioned object.

Other embodiments of the present disclosure may provide an anchoring device that anchors watercraft, the anchoring device comprising: a clamping mechanism providing a gap to enclose at least one object; and two elongated members positioned parallel to one another and connected to the clamping mechanism. The clamping mechanism may be formed of two ring members. The at least one object may be a tree, a branch of a tree, a pillar, a piling, and a dock. The anchoring device may be arranged above or below a body of water. The two elongated members may be connected by a pin having a round head at each end, which may be used telescopically, horizontally, or vertically. The pin may have a gap for the two elongated members to rotate or move about the pin. The two elongated members may be capable of rotating around the clamping mechanism. The anchoring device may be fixed to the watercraft at a seat pedestal.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure generally provide an anchoring device. The anchoring device may be arranged above or below a body of water and may secure watercraft to an object that may be located in or near the body of water.

FIGS. 1-5 depict anchoring device 100-500 according to embodiments of the present disclosure. Anchoring device 100-500 may be arranged above or below a body of water and may anchor watercraft including, but not limited to, boats, yachts, kayaks, and jet skis to one or more objects including, but not limited to, trees, pillars, bridge pilings, and docks. It should be appreciated that the one or more objects may be made of concrete, steel, wood, plastic, and other materials. Anchoring device 100-500 may be integrated with or fixed to watercraft at a seat pedestal in embodiments of the present disclosure. It should be appreciated that anchoring device 100-500 may be attached to watercraft without departing from the present disclosure. It also should be appreciated that there may be embodiments of the present disclosure where anchoring device 100-500 is integrated with or fixed to watercraft at a position or place other than the seat pedestal without departing from the present disclosure.

Figure 1:
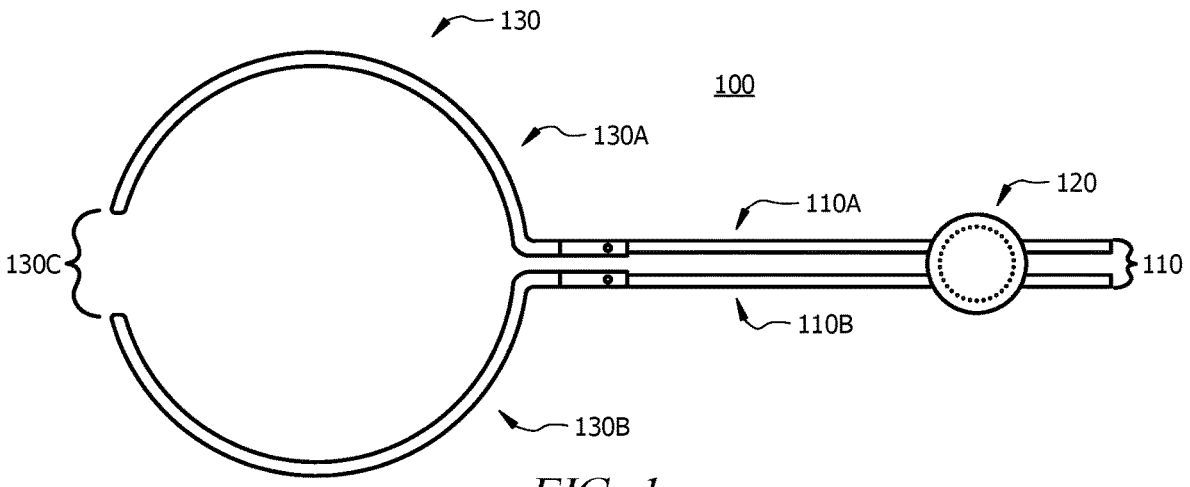
FIG. 1 is a top view of an anchoring device according to an embodiment of the present disclosure.

FIG. 1 depicts anchoring device 100 according to an embodiment of the present disclosure. Anchoring device 100 may include pedestal 110 that may be formed by parallel elongated members 110A, 110B that may be connected by pin 120. Anchoring device 100 also may include clamping mechanism 130 that may be formed by two ring members 130A, 130B. While the clamping mechanism is described as being formed by two ring members, there may be embodiments of the present disclosure where the members may be a shape other than a ring shape. Clamping mechanism 130 may provide space or gap 130C that may be provided to enclose an object or a portion thereof. Clamping mechanism 130 may be connected to elongated members 110A, 110B by attaching ring members 130A, 130B to elongated members 110A, 110B.

Figure 2:
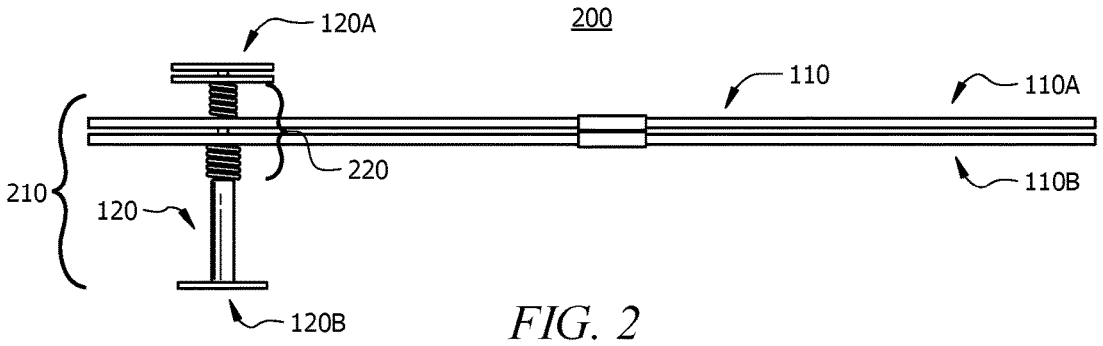
FIG. 2 is a side view of an anchoring device according to an embodiment of the present disclosure.

FIG. 2 depicts anchoring device 200 according to an embodiment of the present disclosure. Anchoring device 200 may include pedestal 110 that may be formed by parallel elongated members 110A, 110B that may be connected by pin 120. It should be appreciated that pin 120 may include round heads 120A, 120B at each end of pin 120. While heads 120A, 120B are described as round, it should be appreciated that heads 120A, 120B may be formed in other shapes and sizes without departing from the present disclosure. In some embodiments of the present disclosure, heads 120A, 120B may be telescopic and/or used horizontally or vertically. Pin 120 may have height 210 and may provide gap 220 that may secure elongated members 110A, 110B. While a certain height and gap may be identified in FIG. 2, it should be appreciated that this height and gap may be variable as long as pin 120 has a height and gap that allow it to secure the elongated members in embodiments of the present disclosure.

Figure 3:
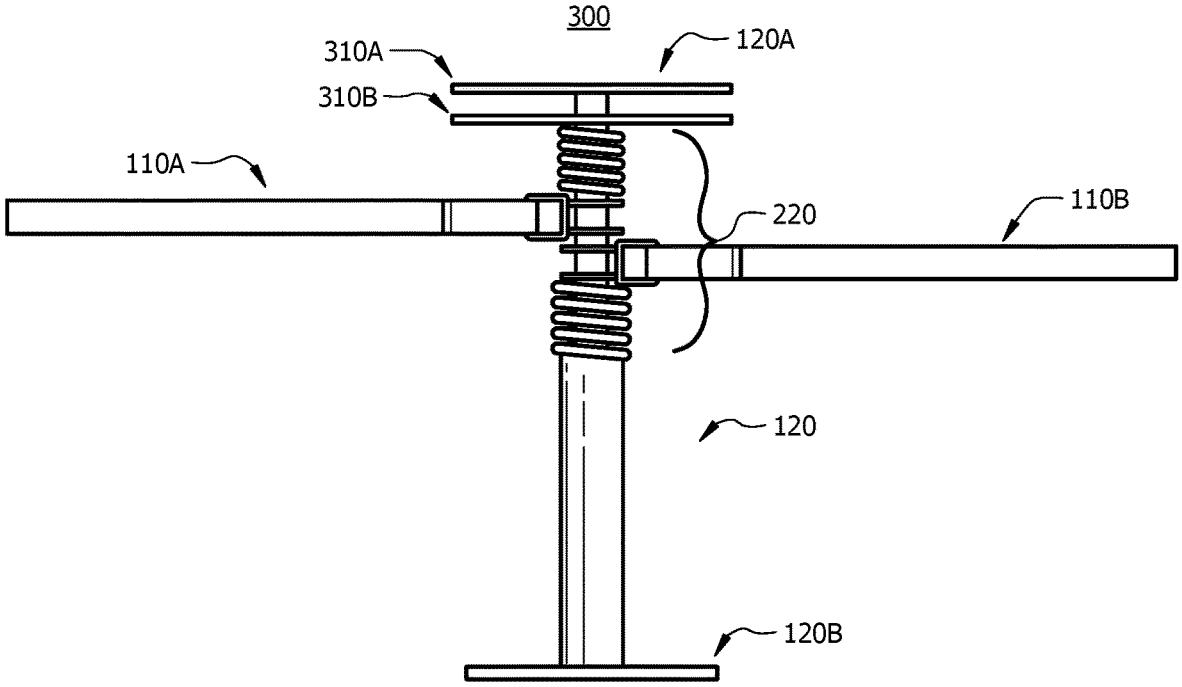
FIG. 3 is a side view of an anchoring device according to an embodiment of the present disclosure.

FIG. 3 depicts anchoring device 300 according to an embodiment of the present disclosure. Anchoring device 300 may provide parallel elongated members 110A, 110B that may be connected by pin 120. It should be appreciated that pin 120 may provide round heads 120A, 120B at each end of pin 120. It should also be appreciated that round head 120A may provide two parallel round members 310A, 310B. Again, while heads 120A, 120B are described as round, it should be appreciated that heads 120A, 120B may be formed in other shapes and sizes without departing from the present disclosure. It should further be appreciated that pin 120 may provide gap 220 that may allow elongated members 110A, 110B to rotate or move about pin 120. Again, while a certain height and gap may be identified in FIG. 3, it should be appreciated that this height and gap may be variable as long as pin 120 has a height and gap that allow the elongated members to rotate or move about the pin in embodiments of the present disclosure.

Figure 4:
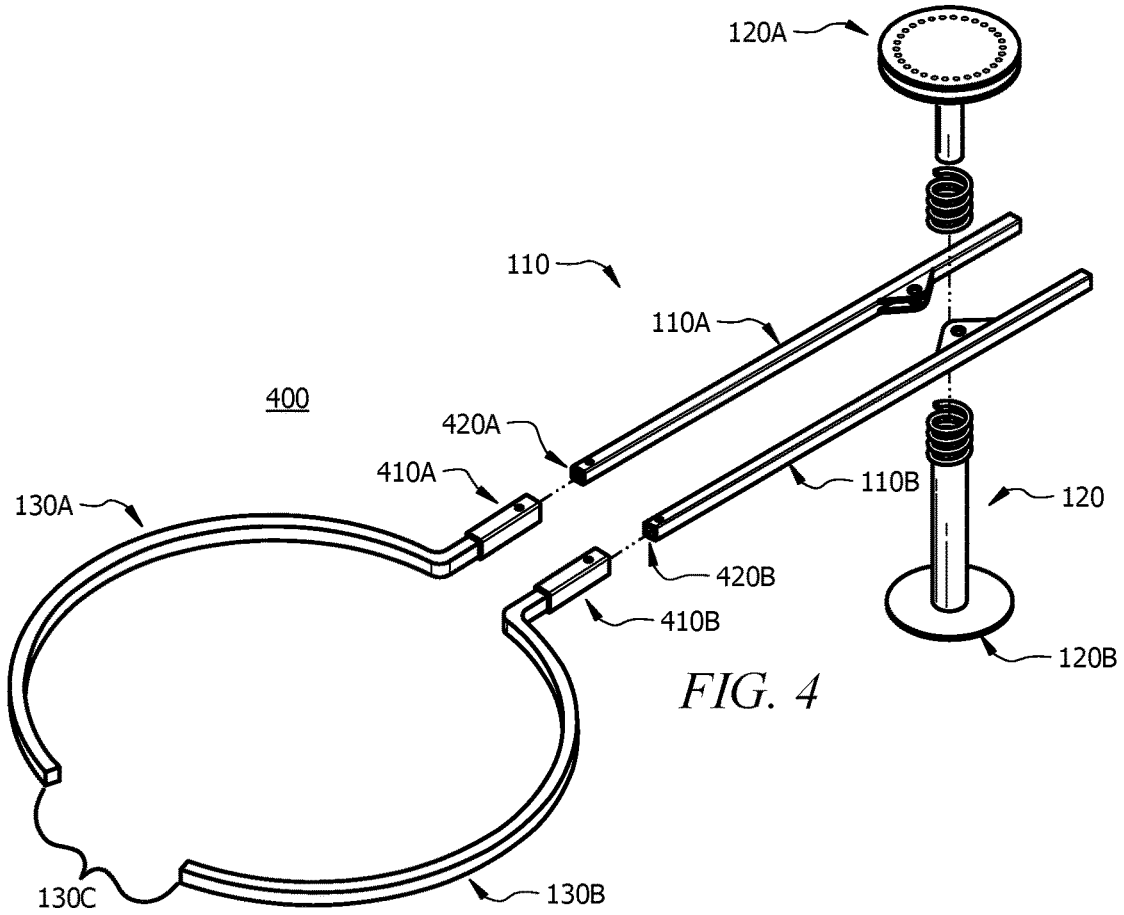
FIG. 4 is a perspective view of an anchoring device according to an embodiment of the present disclosure.

FIG. 4 depicts anchoring device 400 according to an embodiment of the present disclosure. Anchoring device 400 may include pedestal 110 that may be formed by parallel elongated members 110A, 110B connected by pin 120. It should be appreciated that elongated members 110A, 110B may be rotatable around clamping mechanism 130 in embodiments of the present disclosure. It should be appreciated that pin 120 may provide round heads 120A, 120B at each end of pin 120. It should also be appreciated that pin 120 may be separable from elongated members 110A, 110B and may provide ease of replacing and repairing pedestal 110 and clamping mechanism 130. Clamping mechanism 130 may be formed by two ring members 130A, 130B that may provide female connectors 410A, 410B, respectively, that may be arranged to connect with male connectors 420A, 420B provided by elongated members 110A, 110B, respectively. Again, while the clamping mechanism is described as being formed by two ring members, there may be embodiments of the present disclosure where the members may be a shape other than a ring shape. It also should be appreciated that the ring members may be provided in a standard size and/or may be customized without departing from the present disclosure. Clamping mechanism 130 may provide space or gap 130C that may be arranged to enclose an object or a portion thereof.

Figure 5:
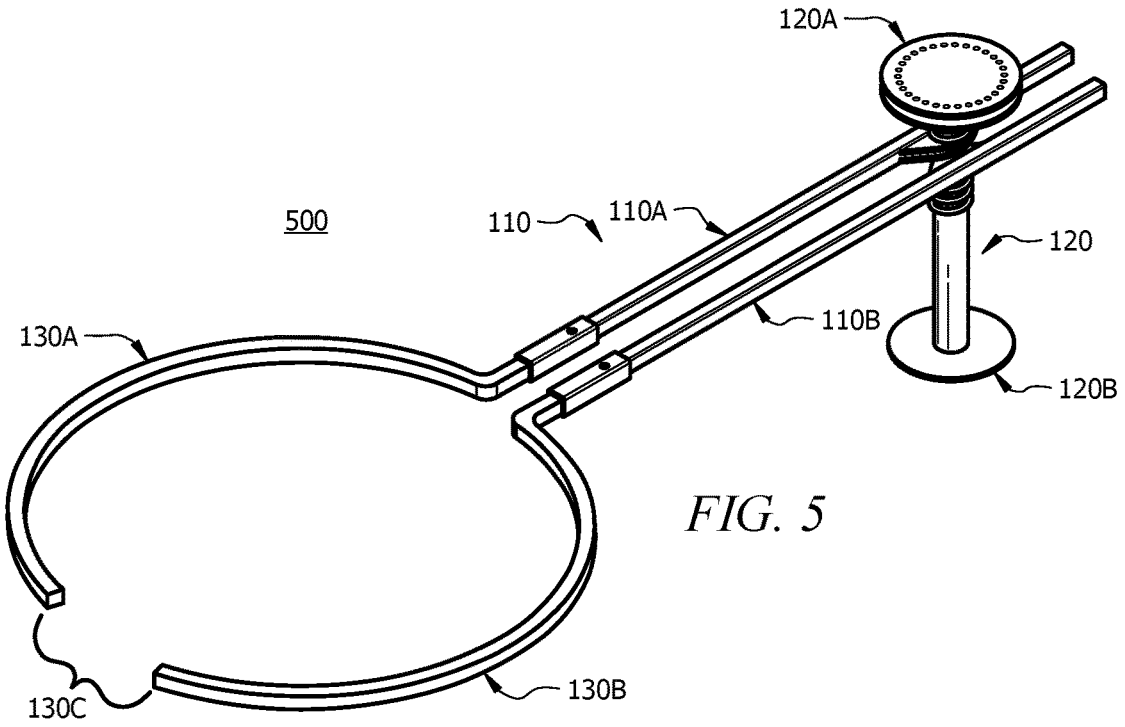
FIG. 5 is a perspective view of an anchoring device according to an embodiment of the present disclosure.

FIG. 5 depicts anchoring device 500 according to an embodiment of the present disclosure. Anchoring device 500 may provide pedestal 110 that may be formed by parallel elongated members 110A, 110B connected by pin 120. It should be appreciated that pin 120 may provide round heads 120A, 120B at each end of pin 120. It should also be appreciated that pin 120 may be separable from elongated members 110A, 110B and may provide ease of replacing and repairing pedestal 110 and clamping mechanism 130. Anchoring device 500 may provide clamping mechanism 130 that may be formed by two ring members 130A, 130B. Clamping mechanism 130 may provide space or gap 130C that may be arranged to enclose an object or a portion thereof.

It should be appreciated that anchoring device 100-500 may be manufactured using metal including, but not limited to, stainless steel. However, the anchoring device may be manufactured of other materials, including but not limited to, plastic, without departing from the present disclosure. Anchoring device 100-500 may provide a reliable attachment means for securing watercraft to one or more vertical objects. It should be appreciated that anchoring device 100-500 also may provide a reliable attachment means to non-vertical objects or horizontally-positioned objects, such as a branch of a tree, without departing from the present disclosure. It should also be appreciated that connecting anchoring device 100-500 to one or more objects may be performed quickly and may not require significant instruction and/or skill. It should further be appreciated that anchoring device 100-500 may be used in a body of water without departing from the present disclosure. Watercraft may not require anchoring device 100-500 to be utilized in combination with a traditional anchoring mechanism to remain secured to an object.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An above water anchoring device, comprising:

a pedestal formed by two elongated members connected by a pin; and a clamping mechanism formed by two ring members, the clamping mechanism connected to the two elongated members, the two ring members each including a female connector arranged to connect with a male connector provided by each of the two elongated members.

2. The anchoring device according to claim 1, wherein the pin provides a round head at each end of the pin.

3. The anchoring device according to claim 1, wherein the pin is separable from the two elongated members.

4. The anchoring device according to claim 1, wherein the two ring members are arranged to anchor to at least one vertical object.

5. The anchoring device according to claim 4, wherein the pedestal is attached to the at least one vertical object with the clamping mechanism.

6. The anchoring device according to claim 1, wherein the pedestal is fixed to a watercraft.

7. The anchoring device according to claim 6, wherein the watercraft is a boat, a yacht, a kayak, or a jet ski.

8. The anchoring device according to claim 1, wherein the two ring members are arranged to anchor to at least one horizontally-positioned object.

9. An anchoring device that anchors watercraft, the anchoring device comprising:

a clamping mechanism providing a gap to enclose at least one object, the clamping mechanism formed by two ring members; and two elongated members positioned parallel to one another and connected to the clamping mechanism, the two ring members each including a female connector arranged to connect with a male connector provided by each of the two elongated members.

10. The anchoring device of claim 9, wherein the at least one object is a tree, a branch of a tree, a pillar, a piling, and a dock.

11. The anchoring device of claim 9, wherein the anchoring device is arranged above a body of water.

12. The anchoring device of claim 9, wherein the anchoring device is arranged below a body of water.

13. The anchoring device of claim 9, wherein the two elongated members are connected by a pin having a round head at each end.

14. The anchoring device of claim 13, wherein the round head at each end of the pin is used telescopically, horizontally, or vertically.

15. The anchoring device of claim 13, wherein the pin has a gap for the two elongated members to rotate or move about the pin.

16. The anchoring device of claim 9, wherein the two elongated members are capable of rotating around the clamping mechanism.

17. The anchoring device of claim 9, wherein the anchoring device is fixed to the watercraft at a seat pedestal.

* * * * *